United States Patent [19]

Kurano

[11] Patent Number: 5,028,904

[45] Date of Patent: Jul. 2, 1991

[54] INDUCTANCE COIL

[75] Inventor: Shinichi Kurano, Fukui, Japan

[73] Assignee: Murata Manufacturing Co., Ltd., Nagaokakyo, Japan

[21] Appl. No.: 555,611

[22] Filed: Jul. 23, 1990

[30] Foreign Application Priority Data

Jul. 24, 1989 [JP] Japan ..... 1-192072

[51] Int. Cl.[5] ..... H01F 27/02

[52] U.S. Cl. ..... 336/96; 336/205

[58] Field of Search ..... 336/96, 205; 264/272.19; 29/602.1, 606

[56] References Cited

U.S. PATENT DOCUMENTS 3,611,226 10/1971 Cotton ..... 336/96 X 4,019,167 4/1977 Baker ..... 336/96

*Primary Examiner*—Thomas J. Kozma

*Attorney, Agent, or Firm*—Burns, Doane, Swecker & Mathis

[57] ABSTRACT

An inductance coil which is completed by casting resin around the body comprising a bobbin wound with a coil and a couple of U-shaped cores inserted in a center hole of the bobbin with the end faces adherent to each other to form a closed-loop magnetic path. The couple of cores are coated with mold releasing agent to assure the adhesion of the end faces.

2 Claims, 1 Drawing Sheet

INDUCTANCE COIL

BACKGROUND OF THE INVENTION

1. Field of the Invention

The present invention relates to an inductance coil such as a common mode choke coil.

2. Description of Related Art

Common mode choke coils have to satisfy the safety standard, and in order to do that, the core and the coil have to be kept at a distance to assure insulation between the core and the coil. For this reason, there had been conventionally a limit in the number of times of winding the coil. To fill the gap between the core and the coil with insulating resin, however, has replaced the way of winding the coil within the limit, and as a result, it has become possible to obtain a compact choke coil wherein a coil is wound a larger number of times and the inductance is large. However, there is still a problem on choke coils for which divided type cores are used. Specifically, with regard to a type of choke coil where a couple of U-shaped cores (for example, cores 10 as shown in FIG. 1) are inserted in a center hole of the bobbin with the end faces adherent to each other to form a closed-loop magnetic path, when the cast: insulating resin hardens, the cores slip out of place because of the stress caused by shrinkage of the resin, impairing the adhesion of the end faces. Consequently, the inductance is lowered. Although the insulating resin is cast for the purpose of raising the inductance, it is difficult to accomplish the purpose in this situation.

SUMMARY OF THE INVENTION

It is therefore an object of the present invention to prevent a fall in inductance of an inductance coil where divided type cores are used and resin casting processing is performed.

In order to attain the object, an inductance coil according to the present invention comprises a bobbin wound with a coil and a couple of U-shaped cores inserted in a center hole of the bobbin with the end faces adherent to each other to form a closed-loop magnetic path. The couple of cores are coated with mold releasing agent, and the inductance coil is completed by casting resin around the bobbin and the cores. Because of the mold releasing agent existing between the resin and the cores, the resin slips on the cores when it hardens and shrinks, preventing the cores from slipping out of place. Thus, the adhesion of the end faces of the cores is assured, and consequently a fall in inductance is prevented.

Various kinds of substances such as silicon compounds, fluorine compounds, etc. may be used as the mold releasing agent, and preferably the cores are coated with the mold releasing agent except for the end faces which are to adhere to each other.

BRIEF DESCRIPTION OF THE DRAWINGS

This and other objects and features of the present invention will become apparent from the following description taken in conjunction with the preferred embodiments thereof with reference to the accompanying drawings, in which.

DETAILED DESCRIPTION OF THE PREFERRED EMBODIMENTS

An examplary inductance coil embodying the principles and features of the present invention is hereinafter described in reference to the accompanying drawings.

Figure 1:
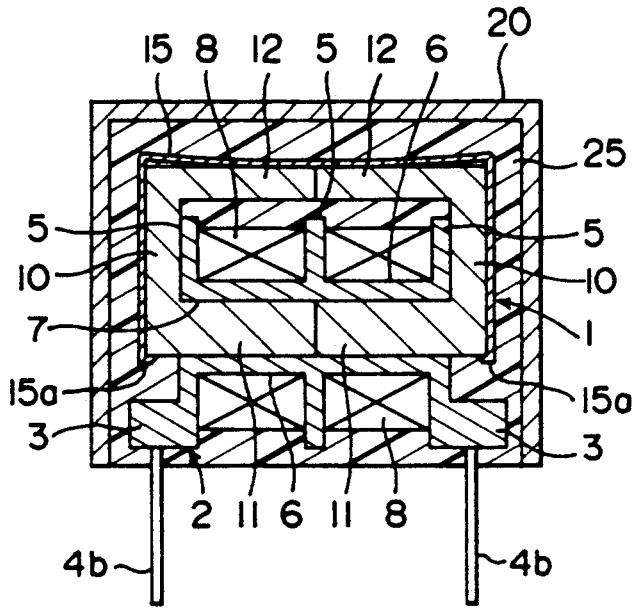
FIG. 1 is a vertical sectional view of an inductance coil according to the present invention.
Figure 2:
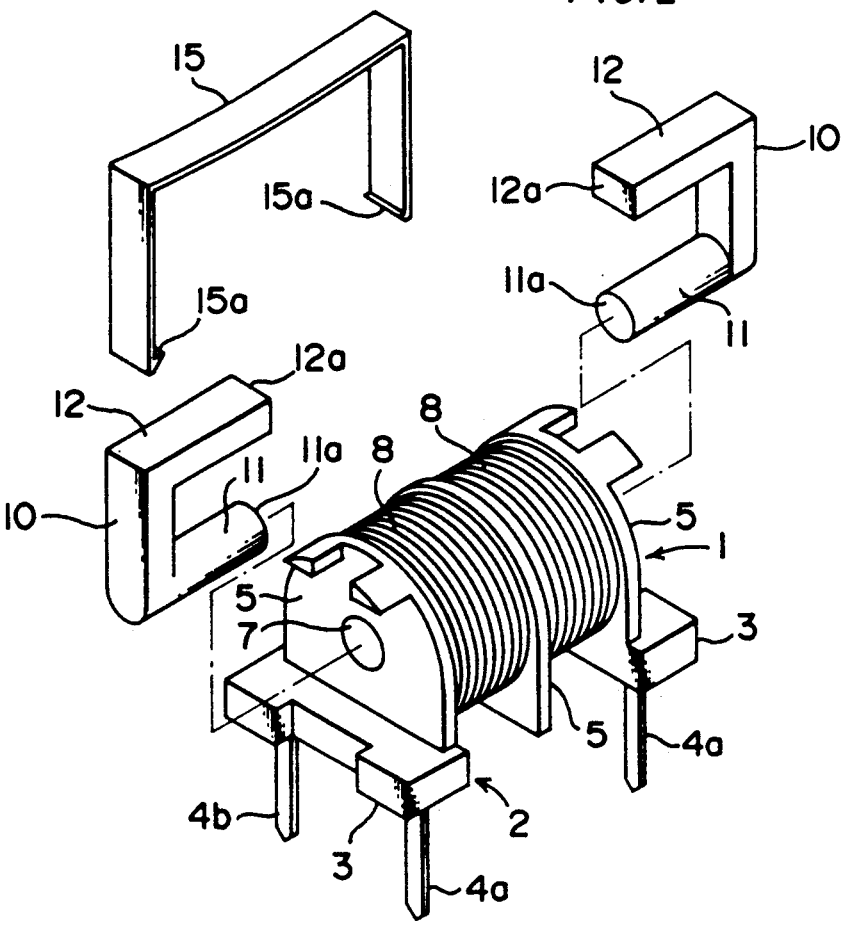
FIG. 2 is an exploded perspective view of the inductance coil shown in FIG. 1.

In FIGS. 1 and 2, numeral 1 denotes a choke coil, and the choke coil 1 comprises a bobbin 2 and coils 8. The bobbin 2 comprises base portions 3, flanges 5 and barrels 6, and a hole 7 is formed at the center of the bobbin 2. The coils 8 are coiled around the barrels 6 and electrically connected with terminals **4*a* and 4*b*** respectively.

Numerals 10 denote a couple of U-shaped cores, and each of the cores 10 has a first protrusion 11 which is cylindrical, and a second protrusion 12 which is a square pole. The protrusions 11 of the cores 10 are inserted into the center hole 7 of the bobbin 2 from the both sides so that the end faces **11*a* of the protrusions 11 are adherent to each other, and thereby a closed-loop magnetic path is formed. The cores 10 are coated with mold releasing agent beforehand except for the end faces 11*a* and 12*a* which are to adhere to each other. After the respective protrusions 11 of the cores 10 were inserted in the center hole 7, an elastic fitting 15 is fitted on the cores 10 with the edge claws 15*a* engaging with the corners of the cores 10 respectively in order to fix the cores 10**.

After the choke coil 1 as composed above was loaded in a case 20, resin 25 is cast, and thus made is a finished product of an inductance coil (common mode choke coil). The resin 25 shrinks slightly as it hardens. However, the stress which will be exerted on the cores 10 when the resin 25 hardens is absorbed by the mold releasing agent which exists between the resin 25 and the cores 10, and there is no fear of causing a gap between the end faces **11*a* and 12*a***, thereby preventing a fall in inductance.

The mold releasing agent is to be selected from silicon compounds and fluorine compounds in accordance with the materials of the resin 25.

According to the experiments by the inventor, the decrease in inductance is about 2% when the cores 10 are coated with silicon-contained mold releasing agent, while the decrease in inductance is about 10% to 30% when the cores 10 are not coated with any mold releasing agent.

Further, it is possible that the divided type cores 10 are coated with varnish or the like except for the end faces which are to adhere to each other and are made into one piece before coating the cores 10 with the mold releasing agent. It is also a possible procedure that after the choke coil 1 was assembled (the cores 10 are coated with the mold releasing agent), the choke coil 1 is dipped into the mold releasing agent and loaded in the case 20, and then the melted resin is cast.

Furthermore, an inductance coil according to the present invention may be applied to other parts as well as choke coils.

Although the present invention has been described in connection with the preferred embodiments thereof, it is to be noted that various changes and modifications are apparent to those who are skilled in the art. Such changes and modifications are to be understood as included within the scope of the present invention as defined by the appended claims.

WHAT IS CLAIMED IS:

1. An inductance coil, comprising:

a bobbin which is made of insulating material;

a coil wound around the bobbin;

a couple of U-shaped cores inserted in a center hole of the bobbin with the end faces adherent to each other to form a closed-loop magnetic path; and resin cast around the cores and the bobbin, wherein the couple of cores have been coated with mold releasing agent before the resin is cast.

2. An inductance coil as claimed in claim 1, wherein the couple of cores are coated with mold releasing agent except for the end faces which ar to adhere to each other.

* * * * *